US010476216B2

(12) United States Patent
Byrne et al.

(10) Patent No.: US 10,476,216 B2
(45) Date of Patent: Nov. 12, 2019

(54) DRAPE-OVER ARTICLE WITH ELECTRICAL OUTLETS

(71) Applicants: Norman R. Byrne, Ada, MI (US); Peter Stathis, San Francisco, CA (US)

(72) Inventors: Norman R. Byrne, Ada, MI (US); Peter Stathis, San Francisco, CA (US)

( * ) Notice: Subject to any disclaimer, the term of this patent is extended or adjusted under 35 U.S.C. 154(b) by 0 days.

(21) Appl. No.: 15/858,386

(22) Filed: Dec. 29, 2017

(65) Prior Publication Data

US 2018/0191112 A1 Jul. 5, 2018

Related U.S. Application Data

(60) Provisional application No. 62/441,095, filed on Dec. 30, 2016.

(51) Int. Cl.

| | |
|---|---|
| ***H01R 25/00*** | (2006.01) |
| ***H01R 13/66*** | (2006.01) |
| ***A47C 7/72*** | (2006.01) |
| *H01R 13/60* | (2006.01) |

(52) U.S. Cl.

CPC ..... *H01R 25/006* (2013.01); *A47C 7/72* (2013.01); *H01R 13/6675* (2013.01); *H01R 13/60* (2013.01)

(58) Field of Classification Search

CPC ..... H01R 25/006; H01R 13/60; A47C 7/72
See application file for complete search history.

(56) References Cited

U.S. PATENT DOCUMENTS

| | | | | |
|---|---|---|---|---|
| 3,506,820 | A | 3/1970 | Shannon | |
| 4,602,191 | A | 7/1986 | Davila | |
| 4,709,307 | A | 11/1987 | Branom | |
| 5,213,519 | A | 5/1993 | Dorfman | |
| 5,245,717 | A | 9/1993 | Rudy | |
| 5,531,601 | A | 7/1996 | Amoroso | |
| 6,402,336 | B1 | 6/2002 | Reese | |
| 8,283,602 | B2 | 10/2012 | Augustine et al. | |
| 8,292,657 | B2 | 10/2012 | Singh | |
| 8,469,884 | B2 * | 6/2013 | David | A61B 5/7278 128/897 |
| 8,626,297 | B2 * | 1/2014 | Jaax | A61N 1/3787 607/33 |
| 9,173,493 | B1 | 11/2015 | Fulton et al. | |
| 9,407,110 | B2 * | 8/2016 | Lui | A61N 1/3787 |
| 9,666,980 | B2 * | 5/2017 | Pearson | H01R 13/60 |
| 10,116,106 | B2 * | 10/2018 | Byrne | A47C 21/003 |
| 2011/0123038 | A1 * | 5/2011 | Clark | H04R 1/028 381/77 |

(Continued)

*Primary Examiner* — Tho D Ta

(74) *Attorney, Agent, or Firm* — Gardner, Linn, Burkhart & Ondersma LLP

(57) ABSTRACT

A drape-over article for furniture includes a flexible or rigid body that has an inverted U-shape, or is capable of assuming an inverted U-shape. The body has downwardly-extending inner and outer arm portions spaced apart from one another, and a central bight portion that forms an upper region of the body. An electrical power and/or electronic data outlet is mountable to the outer arm portion and is accessible along an outer surface of the outer arm portion. The electrical power and/or electronic data outlet can be energized by an electrical power source such as a wall outlet or an onboard battery.

20 Claims, 2 Drawing Sheets

(56) References Cited

U.S. PATENT DOCUMENTS

| | | | | |
|---|---|---|---|---|
| 2012/0200129 | A1* | 8/2012 | Wilson, Jr. ..... | A47C 7/72<br>297/217.3 |
| 2012/0253433 | A1 | 10/2012 | Rosen et al. | |
| 2013/0234481 | A1 | 11/2013 | Johnson | |
| 2018/0191178 | A1* | 7/2018 | Byrne ..... | A47C 7/72 |

* cited by examiner

DRAPE-OVER ARTICLE WITH ELECTRICAL OUTLETS

CROSS REFERENCE TO RELATED APPLICATION

The present application claims the benefit of U.S. provisional application Ser. No. 62/441,095, filed Dec. 30, 2016, which is hereby incorporated herein by reference in its entirety.

FIELD OF THE INVENTION

The present invention relates to furniture accessories and electrical outlets.

BACKGROUND OF THE INVENTION

Portable electronic devices often require charging of their onboard batteries, capacitors, or other electrical energy storage devices. However, in many circumstances the locations where compatible electrical power sources are available for charging purposes are not conducive to permitting usage of the portable electronic devices while the devices are charging. For example, users seated at a chair or sofa, or resting on a bed, may wish to use a portable electronic device that requires charging, but typical charging cord lengths may not permit usage of the portable electronic device by a user who is seated or otherwise supported at a particular furniture article.

SUMMARY OF THE INVENTION

The present invention provides convenient access to electrical power and/or electronic data outlets for users seated on a furniture article, or for users located nearby the furniture article. The drape-over article may be draped or hung over the arm or back of a chair or sofa, for example, and includes a flexible or rigid body that has an inverted U-shape, or that is capable of assuming an inverted U-shape. The drape-over article has downwardly-extending inner and outer arm portions spaced apart from one another, and a central bight portion that forms an upper region of the body. An electrical power and/or electronic data outlet is mountable to the outer arm portion and is accessible along an outer surface of the outer arm portion. The electrical power and/or electronic data outlet can be energized by an electrical power source such as a wall outlet or an onboard battery.

In one form of the present invention, a drape-over article for furniture includes a body having an inverted U-shape or capable of assuming an inverted U-shape, and an electrical outlet made accessible to users along the body. The body has inner and outer arm portions spaced apart from one another and extending downwardly from a central bight portion that extends between the arm portions. The bight portion forms an upper region of the body. The electrical outlet is mountable to the outer arm portion and is accessible along an outer surface of the outer arm portion. The electrical outlet is configured to receive electrical power from an electrical power source.

According to one aspect, the article includes an outlet chamber at the outer arm portion. The outlet chamber is configured to receive and support the electrical outlet. Optionally, the outlet chamber projects outwardly from an outer surface of the outer arm portion.

According to another aspect, the outlet chamber includes an upper opening configured to receive the electrical outlet, and an outer opening configured to provide access to the electrical outlet when the electrical outlet is inserted into the chamber. Optionally, the outlet chamber includes a lower opening opposite the upper opening. The lower opening is configured to receive an electrical cord associated with the electrical outlet when the electrical outlet is inserted into the chamber. Optionally, the outlet chamber and the outer arm portion are unitarily formed from a flexible sheet material.

According to yet another aspect, the electrical outlet includes at least one high voltage AC power outlet and at least one low voltage DC power outlet. Optionally, an electrical power converter is provided for converting incoming high voltage AC power to a low voltage DC power output that is supplied to the low voltage DC power outlet.

According to a further aspect, there is provided an electrical outlet housing for mounting the electrical outlet. Optionally, an outlet chamber is located at the outer arm portion, and has a shape generally corresponding to that of the electrical outlet housing.

According to still another aspect, the body is made of a flexible sheet material. For example, the flexible sheet material may be made from any one or more of: woven fabric, leather, faux leather, rubber, and rubber-like material.

According to another aspect, the body is made of a rigid or semi-rigid material. For example, the body may be made from any one or more of: wood, metal, resinous plastic, and composite material.

According to a still further aspect, the length of the inner arm portion is substantially the same as the length of the outer arm portion.

Therefore, the present invention provides users seated at or otherwise positioned near a furniture article with access to electrical power and/or electronic data via one or more electrical outlets positioned at a drape-over article that can be placed atop a portion of the furniture article. Optionally, the drape-over article may be used as a blanket for warmth, and simultaneously used to recharge a portable electronic device and/or to provide electronic data connectivity, such as for playing media. The drape-over article may be fitted with electrical power outlets that receive power from an onboard battery or other portable energy storage device for portability, or may be plugged into an electrical power source for substantially continuous power.

These and other objects, advantages, purposes and features of the present invention will become apparent upon review of the following specification in conjunction with the drawings.

DESCRIPTION OF THE PREFERRED EMBODIMENTS

Figure 1:
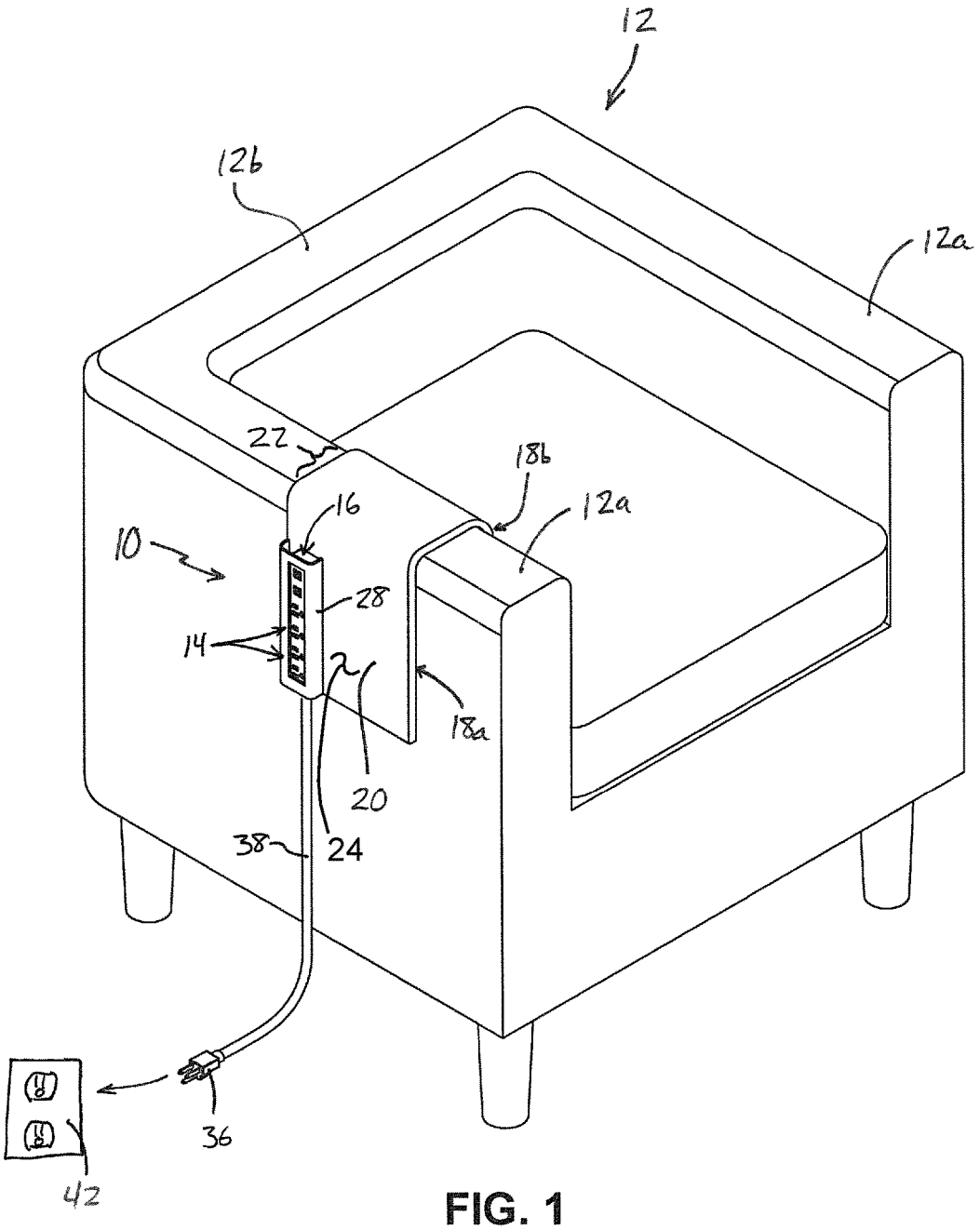
FIG. 1 is a right side perspective view of a drape-over article in accordance with the present invention, shown supported on a chair arm.

Referring now to the drawings and the illustrative embodiments depicted therein, a drape-over article 10 is readily supported along a piece of furniture 12, such as the arm 12*a* or back 12*b* of a chair or sofa (FIG. 1), and provides nearby users with convenient access to one or more electrical outlets 14, such as for charging or powering portable electronic devices including mobile phones, media players, cameras, tablet and laptop computers, small appliances or lighting, and the like. Drape-over article 10 is designed for temporary placement along a furniture article, and may be made from a flexible material so that an upper portion of the article will generally conform to that portion of the furniture article on which it is supported. In an alternative embodiment, drape-over article 10 may be made from a rigid or semi-rigid material that is pre-formed to generally match or approximate the portion of the furniture article on which it is intended to be supported. The electrical outlets 14 may be mounted in a power strip 16, which is accessible along a surface of a downwardly-extending outboard arm or arm portion 18*a* of the drape-over article 10. Electrical outlets 14 are generally accessible to users seated at the furniture article 12, and/or to users located in close proximity to the furniture article 12 on which drape-over article 10 is supported.

Figures 2, 3:
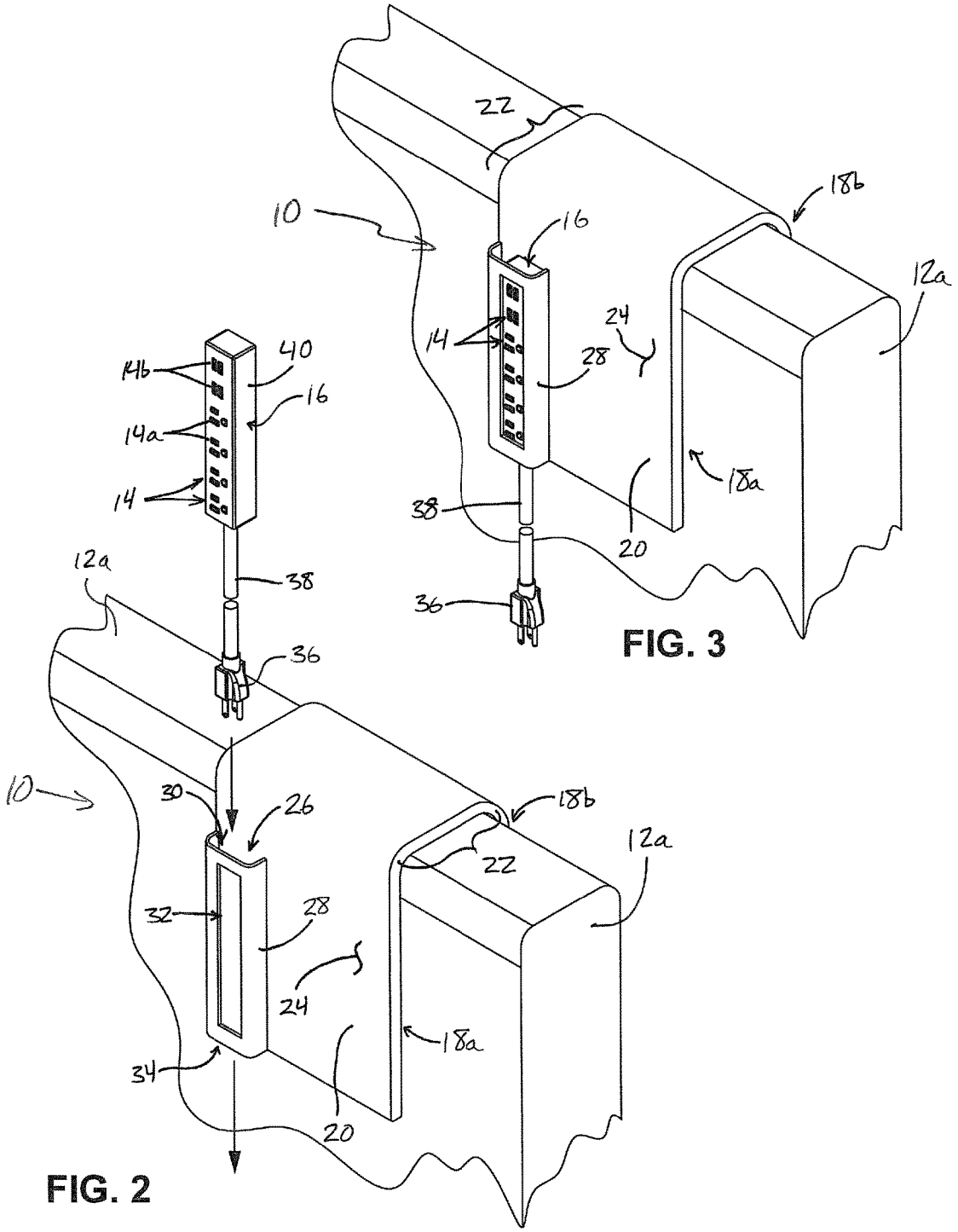
FIG. 2 is an exploded and enlarged perspective view of the drape-over article and power strip of FIG. 1, depicting insertion of the power strip into a receiving chamber.
FIG. 3 is an enlarged perspective view of the drape-over article and power strip of FIG. 1.

Drape-over article 10 includes a main body 20 having two downwardly-extending arm portions including the above-referenced outboard arm portion 18*a* and an inboard arm portion 18*b*, plus an upper/central bight portion 22 that extends between the arm portions 18*a*, 18*b* and forms an upper region of the body 20, such as shown in FIGS. 1-3. Outboard arm portion 18*a* has an outer surface 24 along which electrical outlets 14 are made accessible. In the illustrated embodiment, power strip 16 is inserted into a cavity 26 formed by a storage chamber or pouch 28 that is attached to outer surface 24, such as shown in FIG. 2. In the illustrated embodiment, storage chamber 28 defines three openings to cavity 26, including an upper opening 30 through which power strip 16 may be inserted and removed, an elongate outwardly-facing opening 32 through which electrical outlets 14 are accessible when power strip 16 is positioned in cavity 26, and a lower opening 34 through which a power plug 36 and power cord 38 of power strip 16 are passed as power strip 16 is inserted or removed from cavity 26. Lower opening 34 may be sufficiently large to permit power plug 36 and cord 38 to pass therethrough, while also being sufficiently small to prevent the rest of the power strip 16 from falling through.

In the illustrated embodiment, storage chamber 28 projects outwardly from outer surface 24 of the main body's outboard arm portion 18*a* by a distance that is at least slightly greater than the thickness of power strip 16. Storage chamber 28 may be formed of a flexible fabric or other sheet material, or from a substantially rigid material, which may be the same material as that of main body 20, or may be a different material. In the case of same materials used for storage chamber 28 and main body 20, the storage chamber and main body may be unitarily formed, such as in a weaving process (e.g., woven fabric) or in a molding process (e.g. resinous plastic). Storage chamber 28 is sized and shaped to generally conform to the outer dimensions of power strip 16. Optionally, it is envisioned that the storage chamber may be positioned or formed along an inboard-facing surface of outboard arm portion 18*a* (i.e., opposite outer surface 24), with access to electrical outlets 14 provided through an opening (similar to elongate opening 30) that would be formed in outboard arm portion 18*a*. It is further envisioned that the storage chamber may be positioned or formed centrally to outboard arm portion 18*a*, such as between two separate layers of material that form the outward-facing and inboard-facing surfaces of the outboard arm portion 18*a*.

Power strip 16 includes four high voltage AC power outlets 14*a* and two low voltage DC power outlets 14*b* (illustrated as USB-style outlets) mounted in a power strip housing 40, all of which receive power from an electrical power source such as a wall outlet 42 that is engaged by plug 36 (FIG. 1). Typically, an electrical power converter is contained in the power strip 16 when low voltage DC outlets 14*b* are provided, and is operable to convert incoming high voltage AC power received from wall outlet 42 via cord 38, to a low voltage DC power output that is supplied to the low voltage DC power outlets 14*b*. However, it will be appreciated that in various embodiments there may be provided substantially any combination of one or more high voltage AC power outlets and/or low voltage DC power outlets, without departing from the spirit and scope of the present invention. It will further be appreciated that an onboard power source, such as a rechargeable battery or capacitor, can be incorporated into the drape-over article, such as to provide a limited amount of DC electrical power to low voltage DC outlets while disconnected from an outside power source.

Main body 20 may be made from substantially any flexible sheet material such as woven fabric from natural and/or synthetic fibers, leather, faux leather, rubber, and rubber-like material, or combinations thereof. Optionally, main body 20 may be manufactured in a similar manner and from the same or similar materials as a blanket or rug. Such materials will readily assume an inverted U-shape when draped over a chair arm 12*a* or the like, and will conform to the shapes of many different furniture sections or portions on which drape-over article 10 may be placed by a user. However, it is further envisioned that a rigid or semi-rigid material may be used for main body, such as wood, metal, resinous plastic, or composite material. Still further, an inverted L-shape may be sufficient for the main body, particularly if the lower surface of the upper portion is lined with a high-friction material (e.g., soft rubber or coarse grit) or a self-attaching material (such as the hook portion of a hook-and-loop fastener).

The outboard arm portion 18*a* and inboard arm portion 18*b* may be substantially the same length as one another, or may be manufactured to (or in the case of flexible body material, may be adjusted to) different lengths. For example, it may be desirable for the inboard arm portion 18*b* to have a shorter length than outboard arm portion 18*a*, since the vertical space available along the outboard surface of a chair arm or back is typically longer than the vertical space available along the inboard surface thereof, due to the presence of seat cushions and supports usually located inboard of these inboard arm or back surfaces.

Although power strip 16 and storage chamber 28 are illustrated in a vertically-aligned orientation along outer surface 24 of outboard arm portion 18*a*, many variations of arrangement and location are equally possible. For example, the power strip and storage chamber may be oriented horizontally or diagonally, and may be placed substantially anywhere along either arm portion 18*a*, 18*b* (or even bight portion 22) where it is convenient to provide access to electrical outlets 14. In some embodiments, user preference may dictate that the power strip 16 be placed along an inboard surface of a chair arm or back, simply by reversing the orientation of drape-over article 10 about a vertical axis compared to what is shown in the appended drawings. It is further envisioned that two or more power strips may be placed along either or both arm portions 18*a*, 18*b*, or even along bight portion 22. It is further envisioned that one or more electronic data outlets may be provided in addition to (or in place of) one or more electrical power outlets. For example, by providing an HDMI connector or other video-capable connector with wiring to a remotely located video display, a user seated at furniture 12 can display images or video onto the remote video display by connecting a hand-held media player (such as a smart phone or tablet computer) to the video-capable connector. It should be understood that both electrical power outlets and electronic data outlets may be referred to herein as "electrical outlets," without limitation to power and/or data capability.

Accordingly, the drape-over article of the present invention provides convenient access to electrical charging power and/or electronic data or signal connectivity for users supported at a furniture article. Electrical power outlets and/or electronic data outlets may be mounted in the drape-over article, which may be similar to a blanket or could be a rigid or semi-rigid article, so that a person may access the outlet(s) for charging or data purposes. In some embodiments the drape-over article may be used as a blanket for warmth, and also used to recharge a portable electronic device and/or to provide electronic data connectivity. When one or more electrical power outlets are fitted, those outlets may receive power from an onboard rechargeable battery or other energy storage device, or may receive power from another source such as an electrical wall or floor outlet.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A drape-over article for furniture comprises:

a body having an inverted U-shape or capable of assuming an inverted U-shape, said body including downwardly-extending inner and outer arm portions spaced apart from one another, and a central bight portion extending between said inner and outer arm portions and forming an upper region of said body;

an electrical outlet mountable to said outer arm portion and accessible along an outer surface of said outer arm portion;

a power cord electrically coupled to said electrical outlet and extending outwardly away from said electrical outlet;

an outlet chamber at said outer arm portion and configured to support said electrical outlet, said outlet chamber defining an upper opening configured to receive and provide access to an upper end of said electrical outlet, and a lower opening opposite said upper opening, said lower opening configured to permit said power cord to exit said outlet chamber;

wherein said electrical outlet is configured to receive electrical power from an electrical power source via said power cord.

2. The drape-over article of claim 1, wherein said outlet chamber projects outwardly from said outer surface of said outer arm portion.

3. The drape-over article of claim 1, wherein the length of said inner arm portion is substantially the same as the length of said outer arm portion.

4. The drape-over article of claim 1, wherein said electrical outlet comprises at least one high voltage AC power outlet and at least one low voltage DC power outlet.

5. The drape-over article of claim 4, further comprising an electrical power converter in electrical communication with said low voltage DC power outlet and operable to convert incoming high voltage AC power to a low voltage DC power output that is supplied to said low voltage DC power outlet.

6. The drape-over article of claim 1, further comprising an electrical outlet housing in which said electrical outlet is mounted.

7. The drape-over article of claim 6, wherein said outlet chamber and said electrical outlet housing are correspondingly shaped.

8. The drape-over article of claim 1, wherein said body comprises a flexible sheet material.

9. The drape-over article of claim 8, wherein said flexible sheet material comprises at least one chosen from woven fabric, leather, faux leather, rubber, and rubber-like material.

10. The drape-over article of claim 1, wherein said body comprises a rigid or semi-rigid material.

11. The drape-over article of claim 10, wherein said body comprises at least one chosen from wood, metal, resinous plastic, and composite material.

12. A drape-over article for furniture comprises:

a body having an inverted U-shape or capable of assuming an inverted U-shape, said body including downwardly-extending inner and outer arm portions spaced apart from one another, and a central bight portion extending between said inner and outer arm portions and forming an upper region of said body;

an electrical outlet mountable to said outer arm portion and accessible along an outer surface of said outer arm portion; and an outlet chamber at said outer arm portion, said outlet chamber projecting outwardly from said outer surface of said outer arm portion and configured to receive and support said electrical outlet;

wherein said electrical outlet is configured to receive electrical power from an electrical power source; and wherein said outlet chamber comprises an upper opening configured to receive said electrical outlet, and an outer opening configured to provide access to said electrical outlet when said electrical outlet is inserted into said outlet chamber.

13. The drape-over article claim 12, wherein said electrical outlet comprises at least one high voltage AC power outlet and at least one low voltage DC power outlet.

14. The drape-over article of claim 12, wherein said outlet chamber comprises a lower opening opposite said upper opening, and wherein said lower opening is configured to receive an electrical cord associated with said electrical outlet when said electrical outlet is inserted into said outlet chamber.

15. The drape-over article of claim 14, wherein said outlet chamber and said outer arm portion are unitarily formed from a flexible sheet material.

16. A drape-over article for furniture, said article comprising:

a body having an inverted U-shape or capable of assuming an inverted U-shape, said body including downwardly-extending inner arm portion and a downwardly-extending outer arm portion spaced apart from said inner arm portion, and a central bight portion extending between said inner and outer arm portions and forming an upper region of said body;

an electrical outlet mountable to said outer arm portion and configured to receive electrical power from an electrical power source;

an outlet chamber formed at said outer arm portion and configured to receive and support said electrical outlet, wherein said outlet chamber defines an upper opening configured to receive said electrical outlet, an outer opening configured to provide access to said electrical outlet when said electrical outlet is inserted into said outlet chamber, and a lower opening opposite said upper opening, wherein said lower opening is configured to receive an electrical cord associated with said electrical outlet when said electrical outlet is inserted into said outlet chamber.

17. The drape-over article of claim 16, wherein said body comprises a flexible sheet material.

18. The drape-over article of claim 16, wherein said outlet chamber projects outwardly from an outer surface of said outer arm portion.

19. The drape-over article of claim 16, wherein said electrical outlet comprises a low voltage DC power outlet.

20. The drape-over article of claim 19, further comprising an electrical power converter in electrical communication with said low voltage DC power outlet and operable to convert incoming high voltage AC power to a low voltage DC power output that is supplied to said low voltage DC power outlet.

* * * * *